US005328081A

United States Patent [19]

Saulas

[11] Patent Number: 5,328,081

[45] Date of Patent: Jul. 12, 1994

[54] MULTI-UNIT CARTON WITH INTEGRAL HANDLE

[75] Inventor: Alain Saulas, Chateauroux, France

[73] Assignee: The Mead Corporation, Dayton, Ohio

[21] Appl. No.: 34,637

[22] Filed: Mar. 23, 1993

Related U.S. Application Data

[63] Continuation of Ser. No. 909,517, Jul. 6, 1992, abandoned.

[51] Int. Cl.[5] ..... B65D 5/46

[52] U.S. Cl. ..... 229/117.12; 229/40

[58] Field of Search ..... 229/117.12, 117.22, 229/40; 206/427

[56] References Cited

U.S. PATENT DOCUMENTS

| | | | |
|---|---|---|---|
| 2,732,027 | 11/1955 | Guyer | 229/117.22 |
| 2,955,739 | 10/1960 | Collura | 229/117.12 |
| 3,112,856 | 12/1963 | MacIntosh et al. | 209/117.12 |
| 3,300,119 | 1/1967 | Chaussadas | 229/117.12 |
| 4,378,905 | 4/1983 | Roccaforte | 229/117.22 |
| 4,482,090 | 11/1984 | Milliens | 229/40 |
| 4,498,619 | 2/1985 | Roccaforte | 229/117.22 |
| 4,546,914 | 10/1985 | Roccaforte | 229/117.22 |
| 4,747,534 | 5/1988 | Marie | 229/117.12 |

FOREIGN PATENT DOCUMENTS

| | | | |
|---|---|---|---|
| 0341089 | 11/1989 | European Pat. Off. . | |
| 2483885 | 12/1981 | France | 229/117.22 |
| 1240549 | 7/1971 | United Kingdom | 229/117.12 |

*Primary Examiner*—Gary E. Elkins
*Attorney, Agent, or Firm*—Tsugihiko Suzuki

[57] ABSTRACT

A carton for accommodating a plurality of articles, such as bottles, in a group, comprises a first wall panel, a pair of substantially opposing second wall panels interconnected with the first panel, and a handle structure overlying the first wall panel. The handle structure is manipulative from a flat stowed position in which it closely overlies the first wall panel, to a raised position in which the end portions of the handle structure are displaced inwardly of the carton and that portion of the handle structure intermediate its ends is spaced apart from the first wall panel. The handle structure is formed from a pair of mutually hinged and superposed panel strips formed integrally with each other. Each panel strip of the handle structure is hinged to and formed integrally with the second wall panels.

14 Claims, 3 Drawing Sheets

MULTI-UNIT CARTON WITH INTEGRAL HANDLE

This is a continuation of application Ser. No. 909,517, filed Jul. 6, 1992, now abandoned.

BACKGROUND OF THE INVENTION

This invention relates to an article carrier, more specifically to a carton having a reinforced integral strap handle structure which can be manipulated from a flat stowed position in which it overlies one of the carton walls into a raised position in which it is extended outwardly above that carton wall.

EP-A-89304604.5 relates to a carton having a reinforced handle structure in which end portions of the handle structure are displaceable inwardly into the carton when the carton is lifted by the handle structure so as to shorten the distance between the opposite ends of a central handle strip of the handle structure so that it can be upwardly moved away from the adjacent carton wall. The disclosed handle structure must be formed at the ends of the blank from which the carton is formed.

In designing such a handle structure of a carton for accommodating a relatively large number of articles, it is necessary to take account of the mechanical strength of the handle structure. In view of the intended contents of the carton, i.e., bottles or cans, as well as the manner in which a carton is to be lifted or carried, some flexibility of a specific location of the handle on the carton is desirable.

What is needed, therefore, is a carton with an integral handle structure having good mechanical strength and location flexibility and capable of being manipulated from a flat stowed position in which it overlies one of the carton walls into a raised position in which it is extended above that carton wall.

SUMMARY OF THE INVENTION

The present invention also allows inward movement of the end portions of the handle strip but the handle structure itself is altogether different.

The present invention provides a carton for accommodating a plurality of articles, such as bottles, in a group. The carton comprises a first wall panel, a pair of substantially opposing second wall panels interconnected with the first panel, and a handle structure overlying the first wall panel. The handle structure has end portions which are displaceable inwardly of the carton to allow movement of that portion of the handle structure intermediate its ends away from the first wall panel whereby the handle structure is manipulative from a flat stowed position in which it closely overlies the first wall panel, to a raised position in which the end portions of the handle structure are displaced inwardly of the carton. The handle structure is formed from a pair of mutually hinged and superposed panel strips formed integrally with each other. Each panel strip of the handle structure is hinged to and formed integrally with the second wall panel.

According to a feature of the invention, each second wall panel may comprise two panel sections hingedly connected to each other and hinged to the panel strips of the handle structure. In this construction, the handle structure may overlie one of the panel sections when in the flat stowed position.

According to another feature of the invention, each end portion of the handle structure may comprise a part of the adjacent second wall panel so that, in use, the end portions of the handle structure are disposed substantially vertically relative to the central portion of the handle structure.

According to still another feature of the invention, the handle structure may be in the form of a two-ply strap over the whole of its length.

According to a further feature of the invention, the first wall panel may comprise a pair of hinged strip portions displaceable inwardly of the carton, and the end portions of the handle structure may overlie the hinged strip portions. In a construction where the hinged strip portions are provided, the strip portions may be disposed beneath the handle structure when the handle structure is in its stowed position, and they may be located adjacent the end portions of the handle structure. Also in this construction, the handle structure may be hinged to each of the hinged strip portions, one end of each of the hinged strip portions remote from the end portions of the handle structure including a hinged tab which pivots upwardly as the handle structure is manipulated into its raised position thereby allowing the other end of the hinged strip and overlying end portions of the handle structure to be displaced inwardly of the carton.

Preferably, the lowermost of the panel strips of the handle structure is hinged along one edge of each of the hinged strip portions intermediate the ends of the respective hinged strip portion.

DETAILED DESCRIPTION OF THE PREFERRED EMBODIMENTS

Embodiments of the present invention will now be described, by way of example only, with reference to the drawings.

Figure 1:
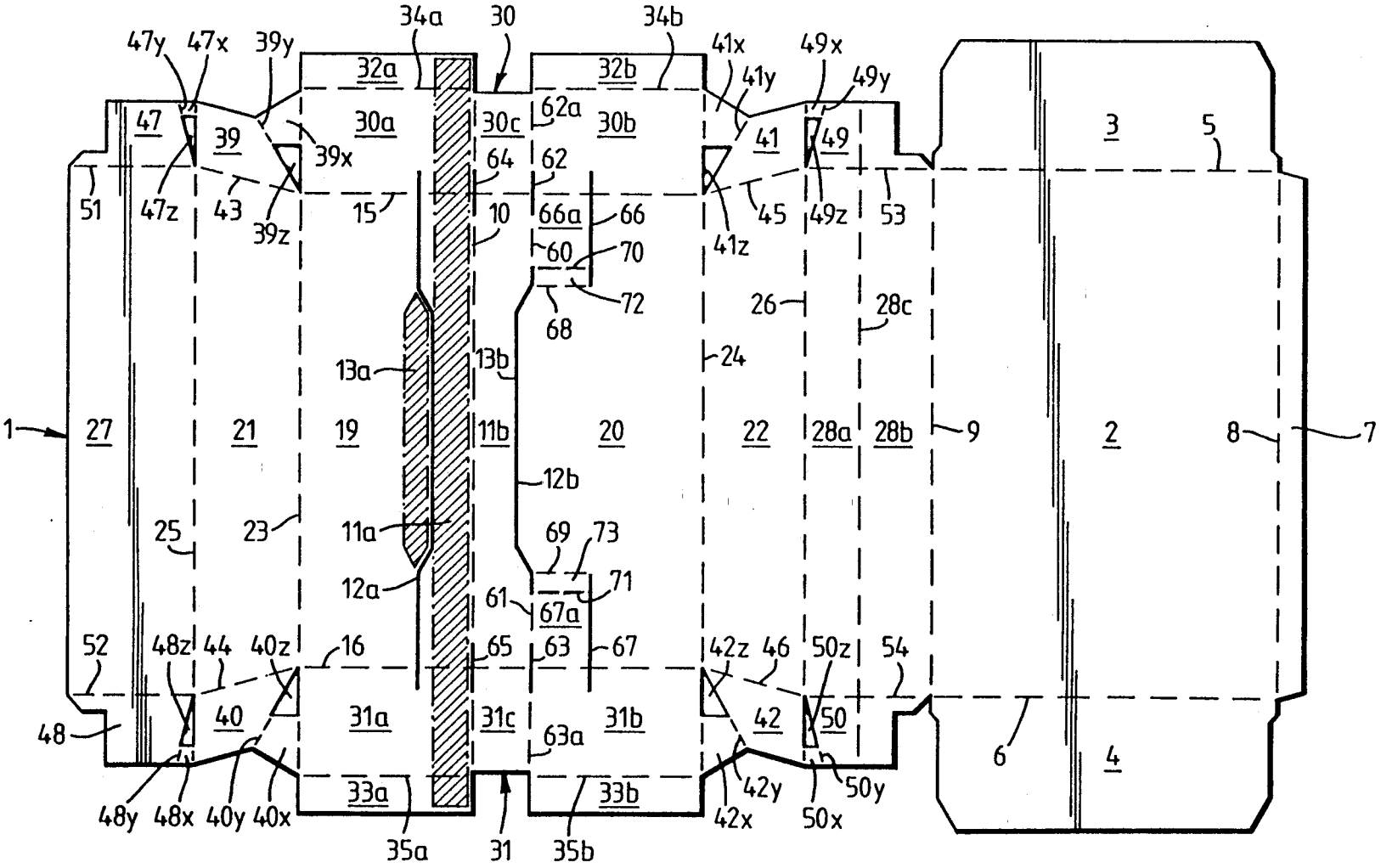
FIG. 1 is a plan view of a blank from which the carrier is formed.

FIG. 1 shows the inside surface of the blank 1 of paperboard or other suitable sheet material, which comprises a rectangular bottom panel 2 to the opposite end edges of which end closure flaps 3 and 4 are hinged along respective fold lines 5 and 6. One side edge of the bottom panel 2 is provided with an edging strip 7 hinged thereto along a fold line 8. The remainder of the blank 1 is hinged to the other side edge of the bottom panel 2 along a fold line 9, and comprises carrier side, top, and upper end panel portions together with foldable carrier handle-forming portions in accordance with the present invention, as will now be described in greater detail.

In particular, the top panel comprises major top panel portions 19 and 20 separated by a pair of central handle-forming strips 11*a* and 11*b* which are symmetrically hinged together along a longitudinal fold line 10. The central region of the pair of strips 11*a* and 11*b* is of reduced width being defined by respective cuts 12*a* and 12*b* which also define the adjacent edges of the adjoining major top panel portions 19 and 20 respectively.

The ends of the top panel portions 19 and 20 and of the strips 11*a* and 11*b* are defined by fold lines 15 and 16 along which upper end panels 30 and 31 are hinged thereto. Each of these upper end panels 30 and 31 comprises three sections 30*a*, 30*b* and 30*c*; 31*a*, 31*b* and 31*c*. The upper end panel sections 30*a* and 31*a* correspond in width to, and essentially form extensions across the fold lines 15 and 16 of the top panel portion 19 and the strip 11*a* combined. Similarly, the upper end panel sections 30*b* and 31*b* correspond in width to the top panel portion 20 and essentially form extensions thereof across the fold lines 15 and 16. The smaller central upper end panel sections 30*c* and 31*c* correspond in width to the adjoining ends of the strip 11*b* and essentially form extensions thereof across fold lines 15 and 16.

The top panels 19 and 20 are each hinged along their outer edges to respective upper side panels 21 and 22 along fold lines 23 and 24. Finally, these upper side panels 21 and 22 are hinged to respective lower side panels 27 and 28 along the respective fold lines 25 and 26. As with the other pairs of panels described above, the lower side panel 28 is identical in size and shape to, but a mirror image of, the other lower side panel 27, and is additionally formed with a longitudinal fold line 28*c* which divides it into two panel portions 28*a* and 28*b*.

Each of the side panels 21, 22, 27 and 28 is provided at each end with a tuck flap hinged thereto. In particular, the upper side panels 21 and 22 are provided with tuck flaps 39 and 40, and 41 and 42 hinged thereto along respective fold lines 43 and 44, and 45 and 46; and the lower side panels 27 and 28 are provided with tuck flaps 47 and 48, and 49 and 50 hinged thereto along respective fold lines 51 and 52, and 53 and 54. Each of the tuck flaps 39, 40, 41, 42, 47, 48, 49 and 50 is formed with an integral triangular tuck flap segment identified in the drawings by the associated tuck flap reference number with the sub-script "x". These are defined by respective fold lines similarly designated in the drawings by the sub-script "y". To facilitate during erection of the carrier, the tuck flap segments for tuck flaps 39, 40, 41, 42, 47, 47, 49 and 50 are truncated at their ends adjoining the associated panels 21, 22, 27 and 28 by triangular apertures identified in the drawings by the same reference number as the associated tuck flap with the sub-script "z".

The tuck flaps of adjacent panels 21 and 27, and 22 and 28 are hinged to one another along extensions of the same fold lines 25 and 26. Likewise the tuck flap segments of tuck flaps 39, 40, 41 and 42 are hinged to the adjacent upper end panel sections 30*a*, 31*a*, 30*a* and 31*b* along extensions of the fold lines 23 and 24 along which the panels 19 and 21, and 20 and 22 are hinged to one another respectively. Each of the upper end panel sections 30*a*, 30*b*, 31*a* and 31*b* is provided with a respective end strip 32*a*, 32*b*, 33*a* and 33*b* hinged thereto along a fold line 34*a*, 34*b*, 35*a* and 35*b*. As described above, the outer edge of the handle-forming strips 11*a* and 11*b* are defined by the cuts 12*a* and 12*b* which are indented toward one another to provide the strips 11*a* and 11*b* with a central region of reduced width. This indentation in the cuts 12*a* and 12*b* also serves to define corresponding edge flaps 13*a* and 13*b* along the adjacent edges of the top panels 19 and 20.

The cut 12*a* extends fully across the top panel 19 and projects at each end a short distance across score lines 15 and 16 into each of the adjoining upper end panel sections 30*a* and 31*a*. The cut 12*b* is substantially the same as cut 12*a* in mirror image except that sections of the cut 12*b*, extending from a short distance inside the fold lines 15 and 16 and ending a short distance from the central indented region of the cut, are replaced by fold line sections 60 and 61 thereby leaving short, isolated cut sections 62 and 63 bridging the fold lines 15 and 16. Aligned with, and extending from the cut sections 62 and 63 to the outer edges of the upper end panels 30 and 31 respectively, are fold line sections 62*a* and 63*a* along which the upper end panel sections 30*b* and 30*c*, and 31*b* and 31*c* are hinged to one another. Cut sections 64 and 65, similar to the cut sections 62 and 63, are formed in the fold line 10 in the regions thereof which bridge fold lines 15 and 16.

The top panel 20 is further formed with a pair of aligned cuts 66 and 67 which are parallel to the cuts 62 and 63 and spaced therefrom by a distance corresponding to the full width of the strip 11*b*. These cuts 66 and 67 extend into the respective upper end panels 30 and 31 the same distance as the cuts 12*a*, 62, 63, 64 and 65 and define short strips 66*a* and 67*a* adjacent the full-width end sections of the strip 11*b*. The ends of the strips 66*a* and 67*a* which lie in the top panel 20 are terminated by respective fold lines 68 and 69 which extend perpendicularly from the ends of the respective cuts 66 and 67 to the points on the cut 12*b* at which it becomes indented towards the cut 12*a* to define the central reduced-width section of the strips 11*a* and 11*b*. Further fold lines 70 and 71 extending parallel to the fold lines 68 and 69 across the strips 66*a* and 67*a* from the respective ends of the cut 12*b* to the cut 66 and 67, define rectangular tabs 72 and 73 at these ends of the strips 66*a* and 67*a*.

The first step in the erection of the carrier, which is sized to hold twenty four bottles, is to apply glue to the inside surfaces (Shown hatched in FIG. 1) of the edge flap 13*a*, and of the strip 11*a* together with the portions of the upper end panels 30 and 31 which are aligned with it. The blank is then folded about the fold line 10 to bring the inner surface of the strips 11*a* and 11*b* along with the portions of the upper end panels 30 and 31 that are aligned therewith, into face-to-face contact with one another whereupon they are bonded together to provide a strong two-ply structure forming a handle structure of the carrier. This two-ply handle structure is then folded about fold lines 60, 62*a*, 61 and 63*a* so as to lie flat against the outside surface of the top panel 20. This bridges the glued inside surface of the edge flap 13*a* into overlapping relationship with the outside surface of the edge flap 13*b* to which it is adhesively bonded. Also the outside surfaces of the strip 11*b* and the aligned portions of the upper end panels 30 and 31 are brought into face-to-face contact with the adjacent surfaces of the top panel 20, including strips 66*a* and 67*a*, and the end panel sections 30*b* and 31*b*.

Adhesive is applied to the outer surface of the edging strip 7, and the edging strip 7 is brought into engagement with the inside surface of the free edge of the side panel 27 to which it is then glued. The partially assembled carrier can then be set up into an open-ended sleeve for loading whereby twenty four bottles are end loaded upright into the sleeve to stand upon the inside surface of the bottom panel 2. Assembly of the carrier is then completed by securing the end closure panels as follows. The tuck flaps 47 and 48, and 49 and 50 at the ends of the side panels 27 and 28 respectively are folded inwardly along the fold lines 51, 52, 53 and 54 to a position perpendicular with their associated side panels 27 and 28, a procedure which is facilitated by folding of the tuck flap segments 47*x*, 48*x*, 49*x* and 50*x* along fold lines 47*y*, 48*y*, 49*y* and 50*y*. This is followed in turn by similarly folding the tuck flaps 39. 40. 41 and 42 of the upper side panels 21 and 22 inwardly along the fold lines 43, 44, 45 and 46 while simultaneously folding the tuck flap segments 39*x*, 40*x*, 41*x* and 42*x* along the respective fold lines 39*y*, 40*y*, 41*y* and 42*y* into flat engagement with the tuck flaps themselves. The upper end panels 30 and 31 are then folded downwardly about the respective fold lines 15 and 16 to bring the inside surfaces of the end regions thereof into partially overlapping engagement with the tuck flaps 39, 41, 47 and 49; and 40, 42, 48 and 50 respectively.

Figure 2:
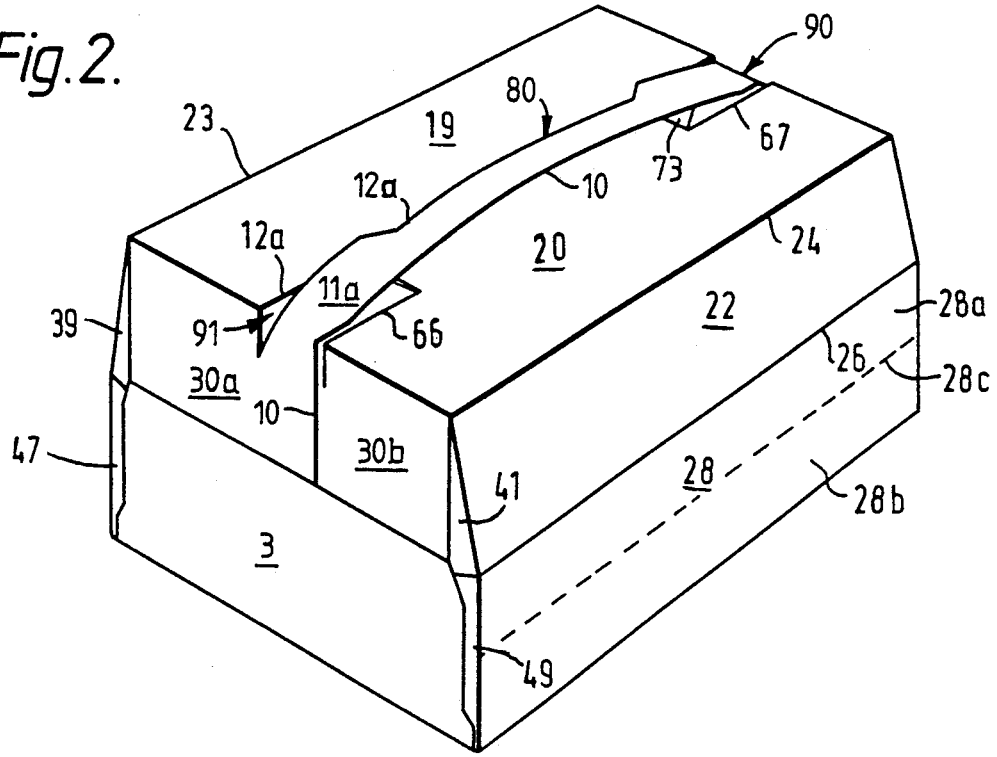
FIG. 2 shows a completed carrier in accordance with the invention formed from the blank of FIG. 1.

Glue is then applied to the outside surfaces of the end strips 32*a*, 32*b*, 33*a* and 33*b*, and the end closure flaps 3 and 4 are folded upwardly along the respective fold lines 5 and 6 to bring the inside surfaces of their edges into overlapping contact with said end strips 32*a*, 32*b*, 33*a* and 33*b* to which they are adhesively bonded. The end closure panels thus formed by the combination of the upper end panels and the end closure flaps 3 and 4 overlap the outside surfaces of the folded tuck flaps 47, 48, 49 and 50; and 39, 40, 41 and 42 and thereby hold them in place at each end of the carrier. This completes the secure and complete enclosure of the bottles as shown in FIG. 2.

In this configuration, the glued strips 11*a* and 11*b* provide a convenient handle structure by means of which the fully loaded and erected carrier can be lifted and carried. The handle structure is in the form of a two-ply strap 80 anchored at each end in the integral two-ply region of the upper end panels 30 and 31 formed by adhesively bonding the end panel sections 30*a* and 31*a* to the sections 30*c* and 31*c* respectively. Because these anchorages for the ends of the strap 80 are disposed substantially vertically in use, they are capable of supporting the full load of the carrier with considerably reduced risk of tearing.

It will be noted also, that the manner in which cuts 66 and 67 and the ends of the cut 12*a* extend into the upper end panels 30 and 31 provides recesses 90 and 91 at the edges of the top panel into which the ends of the strap 80 can engage, in use, to provide greater handroom between the top panel 20 and the strap 80. Thus, as the tension on the strap 80 increases during lifting, and the strap 80 engages deeper into the recesses 90 and 91, the strips 66*a* and 67*a* are drawn inwardly causing the tabs 72 and 73 to fold along the fold lines 68 and 70, and 69 and 71 respectively into an increasingly vertical position. This 'toggle' action of the tabs 72 and 73 ensures that stresses occurring during lifting and carrying are progressively, rather than suddenly, taken up, thereby further reducing the risk of rupture or tearing.

Figure 3:
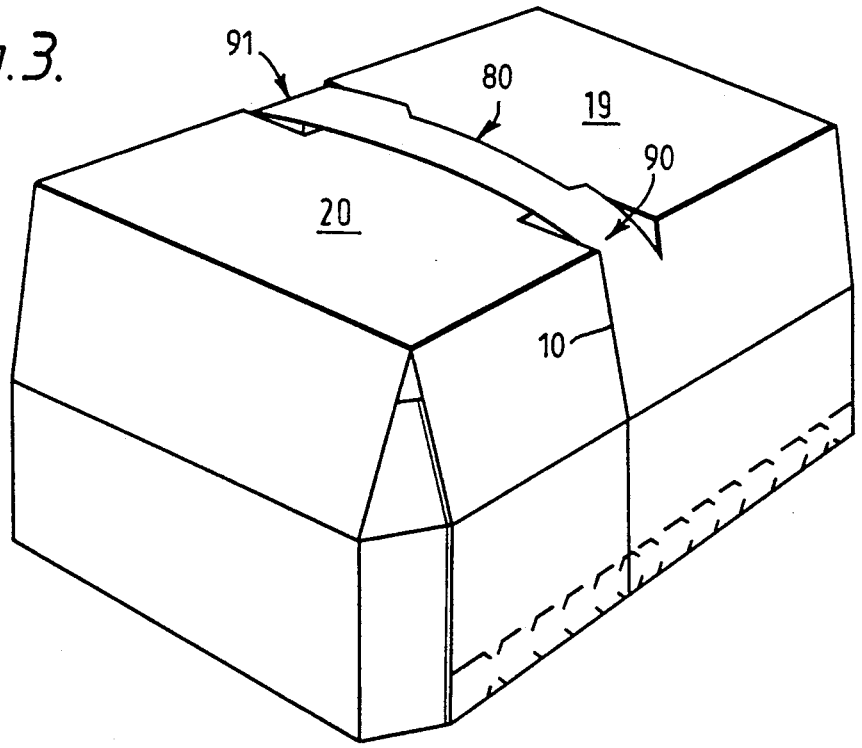
FIGS. 3 and 4 show alternative embodiments of the invention.
Figure 4:
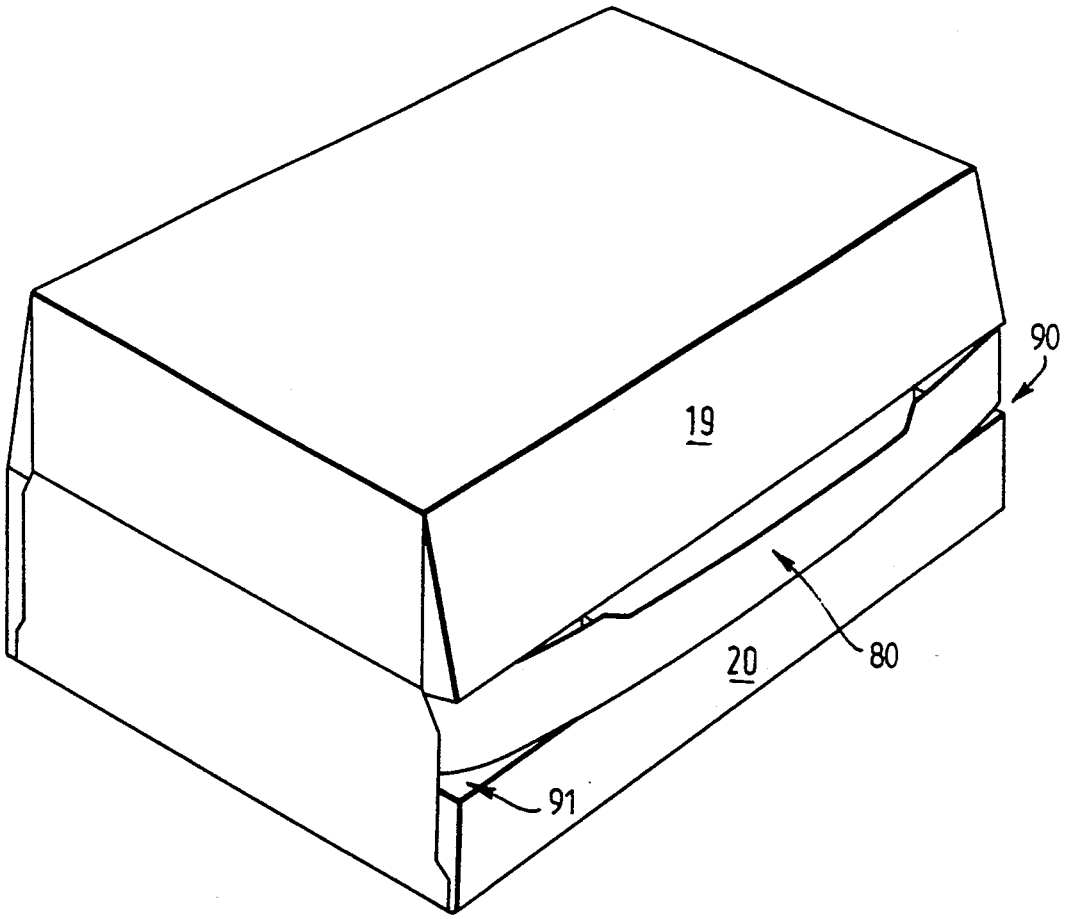

It will be appreciated that the blank so far described has been specifically designed for application to packaging of bottles, which, because of their specific shape, gives rise to the particular configuration of the side panels, the end closure panels and the tuck flaps, most clearly seen in FIG. 1. Obviously a wide variation in the number and configuration of the panels and the tuck flaps is possible within the scope of the present invention depending upon the size, shape and number of articles to be packaged. For example, in the simple case of a box of square or rectangular cross-section, the fold lines defining the tuck flaps along each side edge of the blank would be in a straight line, and only one side panel and one top panel on each side of the central handle-forming strip portions would be required. Indeed, it will be appreciated that other package configurations could similarly be used in conjunction with the two-ply strap handle feature of the present invention. Example of these are shown in FIGS. 3 and 4 in which parts corresponding to those referenced in FIGS. 1 and 2 bear the same reference numbers.

What is claimed is:

1. A carton having a two-ply strap handle and formed from a blank, said blank comprising a first panel and a pair of second panels hinged to said first panel respectively along a pair of spaced generally parallel transverse fold lines, said first panel including first and second carton wall-forming portions and first and second handle-forming strips extending between said transverse fold lines, said handle-forming strips being hinged together along a longitudinal fold line extending between said transverse fold lines whereby said handle-forming strips are foldable about said longitudinal fold line to form a two-ply strap handle extending between said second panels, said first and second wall-forming portions and said first and second handle-forming strips being disposed in the sequence of said first wall-forming portion, said first handle-forming strip, said second handle-forming strip and said second wall-forming portion, each of said second panels including first, second and third mutually foldably interconnected sections hinged along a respective one of said transverse fold lines to said first wall-forming portion, said handle-forming strip and said second handle-forming strip, respectively.

2. The carton according to claim 1, wherein said second and third sections of each of said second panels are mutually hinged along a first crease line aligned and continuous with said longitudinal fold line, said first and second sections of each of said second panels are mutually hinged along a second crease line spaced from and parallel to said first crease line, said first handle-forming strip has a maximum width along said transverse fold lines, and the distance between said first and second crease lines corresponds to said width of said first handle-forming strip.

3. The carton according to claim 2, wherein said second handle-forming strip is separated from said second wall-forming portion by a cut in said first panel, and said cut extends across said transverse fold lines into said third sections of said second panels.

4. The carton according to claim 3, wherein said first section of each of said second panels is formed with a cut line generally parallel to and spaced from said second crease line, and said cut line in said first section extends into said first wall-forming portion of said first panel.

5. The carton according to claim 4, wherein said first and second handle-forming strips are generally equal in width, the distance between said cut line in said first section and said second crease line corresponds to said width of said first handle-forming strip.

6. The carton according to claim 4, wherein a short strip is defined between said cut line and said first handle-forming strip, said short strip has one edge opposite said cut line, and said first handle-forming strip is hinged to said short strip along at least a part of said one edge of said short strip.

7. A carton having an integral strap handle, comprising:

a first wall panel including inner and outer panel portions disposed to overlap each other;

a pair of substantially opposing second wall panels interconnected with said first wall panel, each of said second wall panels comprising inner and outer panel sections overlapping each other, said inner and outer sections being hinged respectively to said inner and outer portions of said first wall panel;

a strap handle having opposite end portions and a central portion extending between said opposite end portions, said opposite end portions respectively comprising parts of said outer sections of said second wall panels, said central portion being formed from said outer portion of said first wall panel and overlying said inner portion of said first wall panel; and a pair of displaceable strips formed respectively from said inner sections of said second wall panels, said displaceable strips underlying and extending along said opposite end portions of said strap handle, each of said displaceable strips being joined to said inner portion of said first wall panel for inward movement relative to said carton to allow displacement of said opposite end portions in an inward direction relative to said carton, said each displaceable strip being hinged to said strap handle whereby upon inward displacement of said opposite end portions, said displaceable strips are drawn inwardly of said carton by said strap handle.

8. The carton according to claim 7, wherein each of said displaceable strips is defined between a cut in a respective one of said inner sections and an opposing edge of said respective inner section underlying a respective one of said outer sections, said cut extending into said inner portion of said first wall panel whereby said each displaceable strip includes one end section formed from said inner portion of said first wall panel.

9. The carton according to claim 8, wherein said one end section of said each displaceable strip includes a hinged tab pivotally joined to said inner portion of said first wall panel for outward movement relative to said carton whereby said each displaceable strip other than said hinged tab thereof is movable inwardly of said carton.

10. The carton according to claim 8, wherein said each displaceable strip is hinged at said one end section other than said hinged tab to said strap handle.

11. The carton according to claim 8, wherein said each displaceable strip is hinged at said one end section thereof to said strap handle.

12. The carton according to claim 11, wherein each of said second wall panels further comprises medial panel section hinged to and interconnecting said inner and outer sections, said inner and outer sections overlaps each other with said medial section interposed therebetween, said opposite end portions respectively further comprises parts of said medial sections of said second wall panels, said central portion comprises a pair of upper and lower superposed panel strips, said upper strip is hinged at opposite ends thereof respectively to said outer sections of said second wall panels, said lower strip is hinged at opposite ends thereof to said medial sections of said second wall panels, and said each displaceable strip is hinged to said lower strip.

13. The carton according to claim 12, wherein said each displaceable strip has one edge opposite said cut, and said lower strip of said strap handle is hinged along at least a part of said one edge of said each displaceable strip.

14. The carton according to claim 12, wherein said upper and lower strips are mutually hinged along a fold line extending along the length thereof.

* * * * *

UNITED STATES PATENT AND TRADEMARK OFFICE

CERTIFICATE OF CORRECTION

PATENT NO. : 5,328,081

DATED : July 12, 1994

INVENTOR(S) : Alain Saulas

It is certified that error appears in the above-identified patent and that said Letters Patent is hereby corrected as shown below:

Column 6, lines 24 and 25, "said handle-forming" should read --said first handle-forming--.

Signed and Sealed this

Thirtieth Day of April, 1996

*Attest:*

Bruce Lehman

BRUCE LEHMAN

*Attesting Officer*

*Commissioner of Patents and Trademarks*